US010156346B2

(12) United States Patent
Jiang

(10) Patent No.: US 10,156,346 B2
(45) Date of Patent: Dec. 18, 2018

(54) DIMMING DEVICES

(71) Applicants: Guangzhou Haoyang Electronic Co., Ltd., Pan Yu Guangzhou, Guangdong (CN); Weikai Jiang, Pan Yu Guangzhou, Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 15/626,314

(22) Filed: Jun. 19, 2017

(65) Prior Publication Data

US 2017/0284641 A1 Oct. 5, 2017

Related U.S. Application Data

(63) Continuation of application No. PCT/CN2015/092605, filed on Oct. 23, 2015.

(30) Foreign Application Priority Data

Dec. 18, 2014 (CN) ..... 2014 1 0799713

(51) Int. Cl.
*F21V 33/00* (2006.01)
*F21V 14/08* (2006.01)
(Continued)

(52) U.S. Cl.
CPC ..... *F21V 14/08* (2013.01); *F21V 3/00* (2013.01); *F21V 11/183* (2013.01); *F21V 14/00* (2013.01); *F21W 2131/406* (2013.01)

(58) Field of Classification Search
CPC ..... F21V 1/00; F21V 3/00; F21V 5/00; F21V 7/00; F21V 9/00
See application file for complete search history.

(56) References Cited

U.S. PATENT DOCUMENTS 5,275,077 A * 1/1994 Kobayashi ..... B26D 3/085 83/30

FOREIGN PATENT DOCUMENTS

CN 2767827 Y 3/2006
CN 101925776 A 12/2010
(Continued)

OTHER PUBLICATIONS

International Search Report for PCT/CN2015/092605 dated Feb. 2, 2016.
Written Opinion for PCT/CN2015/092605 dated Feb. 2, 2016.

*Primary Examiner* — Ali Alavi
(74) *Attorney, Agent, or Firm* — Pearne & Gordon LLP

(57) ABSTRACT

A dimming device comprises a light source, a support having a light path corresponding to the light source, a light diffuser, and light shielding blades having notches. The blades and the diffuser are movably disposed on the support. The blades and the diffuser are actuated by independent actuators. The notches move into and out of the light path with the movements of the blades, and the diffuser covers a portion of notches that is within the light path when moving into and out of the light path. The diffuser's movement relative to the light path is not limited to that of the blades, so the diffuser can be precisely controlled to move into a specific position within the light path with an optimal trajectory and at an optimal time point. The diffuser is integrally formed without slots, ensuring diffusion of all light passing through the covered portion of the notches.

10 Claims, 2 Drawing Sheets

(51) Int. Cl.

| | |
|---|---|
| ***F21V 14/00*** | (2018.01) |
| ***F21V 3/00*** | (2015.01) |
| ***F21V 11/18*** | (2006.01) |
| *F21W 131/406* | (2006.01) |

(56) References Cited

FOREIGN PATENT DOCUMENTS

| | | | |
|---|---|---|---|
| CN | 102753884 | A | 10/2012 |
| CN | 202660474 | U | 1/2013 |
| CN | 203823663 | U | 9/2014 |
| CN | 203823665 | U | 9/2014 |
| CN | 104482505 | A | 4/2015 |
| CN | 204285337 | U | 4/2015 |
| WO | 2011085732 | A1 | 7/2011 |
| WO | 2013142435 | A1 | 9/2013 |

* cited by examiner

DIMMING DEVICES

FIELD OF THE INVENTION

The present invention relates to a dimming device and, in particular, to a dimming device with a precisely controlled dimming effect, particularly useful for stage lighting.

BACKGROUND OF THE INVENTION

The intensity of light on a stage is conventionally adjusted by controlling the intensity of light emitted by the light sources illuminating the stage, in order to meet different light requirements. Two blades symmetrically disposed along the axis of the light beam are used to control the light intensity. Each blade is provided with a notch such that the light beam can be shielded to reduce the intensity when both blades move towards each other without changing the shape of the light beam.

When, however, the edge sharpness of the notches are not well controlled due to manufacturing error, the light could be distorted leading to non-uniform dimming and less sharp light spots. Conventional dimming devices therefore include diffusers attached to the blades at a surface away from the light source and extended beyond the periphery of the blades to cover the notches. The light would be diffused when the diffusers move into the beam zone along with the movement of the blades. Nevertheless, due to the fixed attachments of the diffusers with the blades, the trajectory of the diffusers are completely bound to that of the blades, making optimal movement of the atomizer not possible. Moreover, in the event that the machining precision is not high enough such that a slot is formed or interference occurs when the two diffusers reaches to each other, the light would not be diffused completely and an ideal dimming effects is not achievable.

SUMMARY

The invention aims to provide a dimming device with precisely controlled dimming effect. The dimming device comprises a light source, a support 1, a diffuser 4 for light diffusion and blades 2 for light shielding. The support 1 is provided with a light path 6 corresponding to the light source, and notches are provided on the blades 2. The dimming device is characterized in that the blades 2 and the diffuser 4 are movably disposed on the support 1, with the blades 2 and the diffuser 4 actuated by independent actuators. The notches of the blades 2 move into and out of the light path 6 with the movement of the blades into and out of the light path 6, and the diffuser 4 covers a portion of notches that is within the light path when moving into and out of the light path 6.

When the device is used for light intensity modulation, the blades 2 are actuated to move from beyond the light path to within the light path in order to shield the light beam, such that the intensity of the light is reduced. The diffuser 4 is simultaneously actuated to move from beyond to within the light path to cover a portion of the notches that is within the light path, such that the light is distributed evenly and a soft while sharp light spot edge is thus obtained. When the intensity of the light needs to be enhanced, the blades move away from within towards beyond the light path and the diffuser is simultaneously moved from within towards beyond the light path.

The blades and the diffuser are independently actuated in the present invention such that the movement of the diffuser within or outside the light path is not limited to that of the blades. Therefore, the diffuser can be precisely controlled to move into a specific position within the light path with an optimal trajectory and at an optimal time point to achieve light diffusion. The diffuser 4 is integrally formed and has no slots, ensuring the diffusion of all the light passing through the portion of the notches that is within the range of the light path.

In a preferable embodiment, the positions where blades 2 locate outside the light path 6 are designated as end points and the positions where blades 2 locate inside the light path 6 are designated as starting points. Similarly, and the position where diffuser 4 locates outside the light path 6 is designated as an end point and the position where diffuser 4 locates inside the light path 6 is designated as a starting point. The two blades 2 are disposed at each side of the light path 6 and staggered in the direction of the axis of the light path 6. The blades 2 can be projected to a plane perpendicular to the axis of the light path 6. The projections of the two blades 2 on the projection plane keep symmetrical as each of the blades 2 moves between its starting point and end point. The notches 3 of the blades 2 form a closed circle on the projection plane before reaching respective starting point from respective end point. The diffuser 4, when at its starting point, always completely covers the closed circle projected by the notches 3.

When operating, the blades are actuated to move towards and into the light path during which the light is partially shielded by the blades 2, leading to generation of gradually reduced light intensity. At the same time, the diffuser 4 is actuated to move into the light path such that when a closed circle is just formed on the projection plane by the notches 3 of the blades 2 the diffuser 4 reaches its starting point and covers on the closed circle. Due to the staggered arrangement of the blades along the axis of the light path, the blades 2 could further move toward their starting points so that the projected closed circle is contracted and the diffuser 4, remaining at its starting point, keeps covering the circle. The light, passing in sequence through the blades 2 and the diffuser 4, is therefore gradually controlled and dimmed. The processing of the diffuser 4 enables obtaining an evenly controlled, sharply edged and soft light.

The diffuser 4 is actuated by an actuator such as a motor. The motor is disposed on the support 1 with a main shaft 7 of the motor parallel to the axis of the light path 6. The main shaft 7 is provided with an arm 5 rotatable along with the main shaft 7. The diffuser 4 is disposed at a free end of the arm 5.

In another preferable embodiment, the blades 2 are actuated by actuators such as two motors. The motors are disposed on the support 1 with respective main shaft 7 of the motors parallel to the axis of the light path 6. The two blades 2 are actuated by an independent motor, respectively.

The use of the motors as the actuators for the diffuser and the blades facilitates operations and precise control of the positions of the diffuser and the blades during movement, and is cost effective.

In another preferable embodiment, the blades 2 are actuated by a single motor disposed on the support 1. The main shaft 13 of the single motor is disposed parallel with the axis of the light path 6. A driving wheel 12 is provided to the shaft 13 and rotatable therewith. The driving wheel 12 has a belt 11 in a shape of the digit "8" to drive a driven wheel 10 to reversely rotate. The two blades 2 are driven by the driving wheel 12 and the driven wheel 10 respectively. The single actuator reduces the number of the parts comprised in a dimming device and makes synchronous movements of the two blades possible.

A first stop plunger 9 and a second stop plunger 8 are disposed on the support between which a beam 15 of the arm 5 of the diffuser is disposed. The first and second stop plungers 9, 8 provide position limiting when the diffuser 4 is actuated to move between its starting and end points. The stop plungers have a simple structure and correspond to the starting and end points of the diffuser 4 respectively to facilitate the positioning of the diffuser at its starting and end points.

The beam 15 is integrated with the arm 5 of the diffuser.

A reset plunger 13 is disposed on the support 1 and, correspondingly, a reset bar 14 is provided to an end of one of the blades 2. The reset bar 14 reaches the reset plunger 13 when the corresponding blade is actuated to move to its starting point. The blades, in particular the actuator(s), directly control the path of the reset bar 14. The reset plunger 13 has a simple structure and correspond to the starting point of the blade 2 to facilitate the positioning of the blades at respective starting points.

The blade 2 that is attached to the driving wheel 12 is integrated with the reset bar 14. The notches are provided at an edge of the blades facing the light path and have for example a V, zigzag or a finger shape.

DETAILED DESCRIPTION OF THE INVENTION

Figure 1:
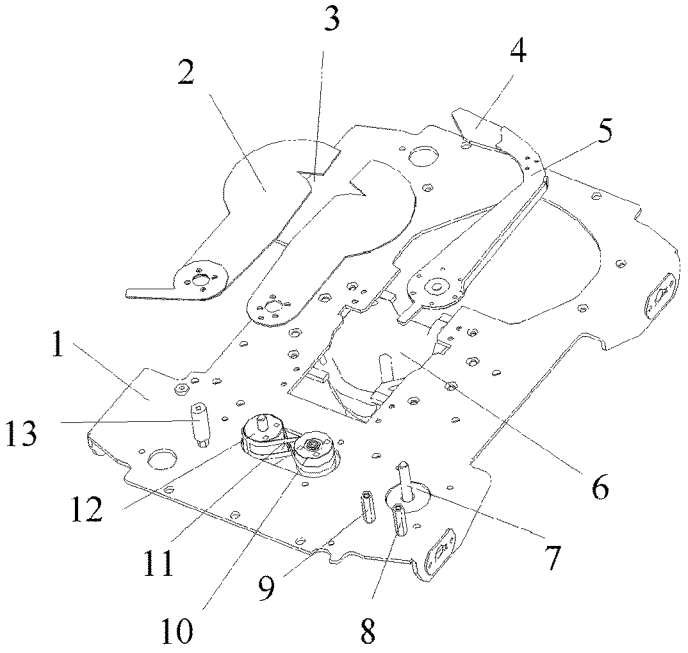
FIG. 1 is an exploded view of the dimming device of the invention.
Figure 2:
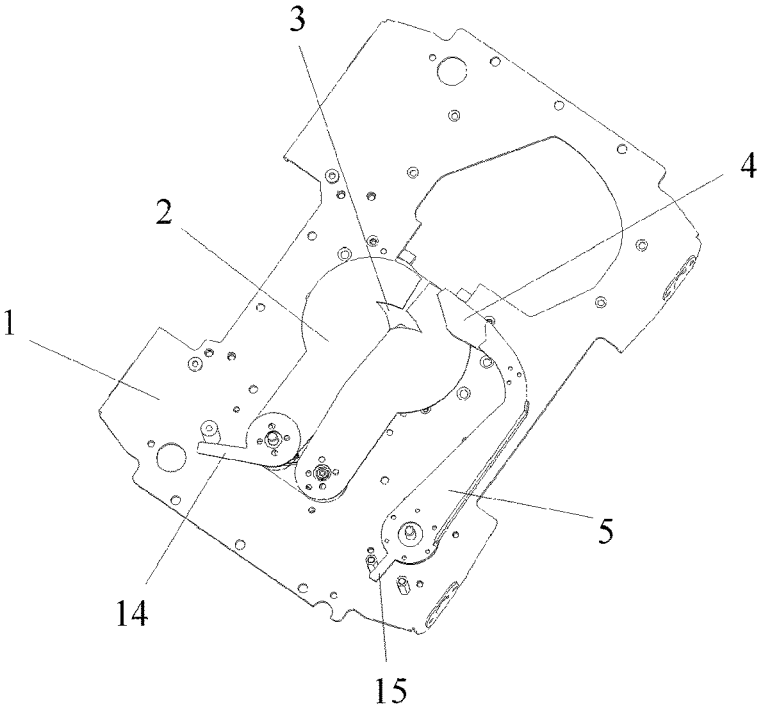
FIG. 2 is a schematic view of the device where the blades are positioned immediately prior to form a closed circle on a projection plane by the notches.
Figure 3:
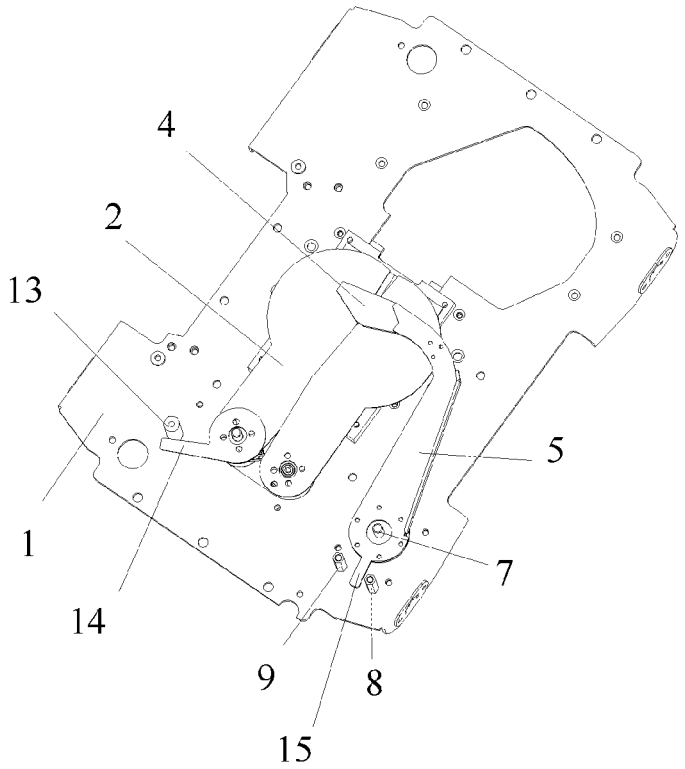
FIG. 3 is a vertical sectional view of FIG. 2 where the blades are positioned to form a closed circle on a projection plane by the notches and the diffuser is at its starting point.

FIGS. 1 to 3 show a dimming device according to one embodiment of the invention. The dimming device comprises a light source (not shown), a support 1, diffuser 4 for diffusing light, and two blades 2 for shielding light. The support 1 is formed a light path 6 for the pass of the light. The blades 2, formed of metal sheet, are provided with notches in a V, zigzag, or a finger shape. The diffuser 4 is a transmission glass with light diffusion property. The blades 2 and the diffuser 4 are movably mounted on the support 1 and driven by independent motors. The support 1 is further provided with a first stopper plunger 9 and a second stopper plunger 9 between which a beam 15 of the arm 5 of the diffuser is disposed. The beam 15 is integrated with the arm 5 of the diffuser. The beam 15 is contacted with the plungers 9, 8 when the arm 5 is actuated to move the diffuser 4 to the starting and end points. A reset plunger 13 is provided on the support 1 and, correspondingly, a reset bar 14 is provided to an end of one of the blades 2. The reset bar 14 reaches the reset plunger 13 when the corresponding blade is actuated to move to its starting point.

The blade 2 that is attached to the driving wheel 12 is integrated with the reset bar 14.

The blades 2 are actuated by a single motor disposed on the support 1. The main shaft 13 of the single motor is disposed parallel with the axis of the light path 6. A driving wheel 12 is provided to the shaft 13 and rotatable therewith. The driving wheel 12 has a belt 11 in a shape of the digit "8" to drive a driven wheel 10 to reversely rotate. The two blades 2 are driven by the driving wheel 12 and the driven wheel 10 respectively. The single actuator reduces the number of the parts comprised in a dimming device and makes synchronous movements of the two blades possible. The blades 2 can also be actuated by two motors disposed on the support 1 when required. The main shafts of the motors are disposed parallel with the axis of the light path 6. Each of the blades 2 are driven by an independent motor and synchronous but opposite movements of both blades need to be ensured.

The diffuser 4 is actuated by a motor. The motor is disposed on the support 1 with a main shaft 7 of the motor parallel to the axis of the light path 6. The main shaft 7 is provided with an arm 5 rotatable along with the main shaft 7. The diffuser 4 is disposed at a free end of the arm 5.

The positions where blades 2 locate outside the light path 6 are designated as end points and the positions where blades 2 locate inside the light path 6 are designated as starting points. Similarly, and the position where diffuser 4 locates outside the light path 6 is designated as an end point and the position where diffuser 4 locates inside the light path 6 is designated as a starting point. The two blades 2 are disposed at each side of the light path 6 and staggered in the direction of the axis of the light path 6. The blades 2 can be projected to a plane perpendicular to the axis of the light path 6. The projections of the two blades 2 on the projection plane keep symmetrical as each of the blades 2 moves between its starting point and end point. The notches 3 of the blades 2 form a closed circle on the projection plane before reaching respective starting point from respective end point. The diffuser 4, when at its starting point, always completely covers the closed circle projected by the notches 3.

When operates, the blades are actuated to move towards and into the light path during which the light is partially shielded by the blades 2, leading to generation of gradually reduced light intensity. At the same time, the diffuser 4 is actuated to move into the light path such that when a closed circle is just formed on the projection plane by the notches 3 of the blades 2 the diffuser 4 reaches its starting point and covers on the closed circle. Due to the staggered arrangement of the blades along the axis of the light path, the blades 2 could further move toward their starting points so that the projected closed circle is contracted and the diffuser 4, remaining at its starting point, keeps covering on the circle. The light, passing in sequence through the blades 2 and the diffuser 4, is therefore gradually controlled and dimmed. The processing of the diffuser 4 enables obtaining an evenly controlled, sharply edged and soft light.

The blades and the diffuser of the dimming device are independently actuated in the present invention such that the movement of the diffuser within or outside the light path is not limited to that of the blades. Therefore, the diffuser can be precisely controlled to move into a specific position within the light path with an optimal trajectory and at an optimal time point to achieve light diffusion. The diffuser 4 is integrally formed and has no slots, ensuring the diffusion of all the light passing through the portion of the notches that is within the range of the light path.

The invention claimed is:

1. A dimming device comprising a light source, a support, a diffuser for light diffusion, and blades for light shielding, the support being provided with a light path corresponding to the light source, and notches being provided on the blades, wherein the blades and the diffuser are movably disposed on the support, with the blades and the diffuser actuated by at least one independent actuator; the notches of the blades move into and out of the light path with the movements of the blades into and out of the light path, and the diffuser covers a portion of notches that is within the light path when moving into and out of the light path.

2. The dimming device of claim 1, where in the positions where blades locate outside the light path are designated as end points and the positions where blades locate inside the light path are designated as starting points, and the position where diffuser locates outside the light path is designated as an end point and the position where diffuser locates inside the light path is designated as a starting point; two blades are disposed at each side of the light path and staggered in the direction of the axis of the light path; the blades are capable of being projected to a plane perpendicular to the axis of the light path; the projections of the two blades on the projection plane keep symmetrical as each of the blades move between its starting point and end point; the notches of the blades form a closed circle on the projection plane before reaching respective starting point from respective end point; and the diffuser, when at its starting point, always completely covers the closed circle projected by the notches of the blades.

3. The dimming device of claim 1, wherein the diffuser is actuated by a motor, the motor is disposed on the support with a main shaft of the motor parallel to the axis of the light path; the main shaft is provided with an arm rotatable along with the main shaft; and the diffuser is disposed at a free end of the arm.

4. The dimming device of claim 2, wherein the blades are actuated by two motors, and the motors are disposed on the support with respective main shaft of the motors parallel to the axis of the light path; and each of the two blades is actuated by one of the two motors.

5. The dimming device of claim 2, wherein the blades are actuated by a single motor disposed on the support; the main shaft of the single motor is disposed parallel with the axis of the light path; a driving wheel is provided to the shaft and rotatable therewith; the driving wheel has a belt in a shape of the digit "8" to drive a driven wheel to reversely rotate; and the two blades are driven by the driving wheel and the driven wheel, respectively.

6. The dimming device of claim 3, wherein a first stop plunger and a second stop plunger are disposed on the support between which a beam of the arm of the diffuser is disposed; and the beam contacts with the first and second stop plungers when the diffuser is actuated by the arm to move between its starting and end points.

7. The dimming device of claim 6, wherein the beam is integrated with the arm of the diffuser.

8. The dimming device of claim 5, wherein a reset plunger is disposed on the support and, correspondingly, a reset bar is provided to an end of one of the blades; the reset bar reaches the reset plunger when the corresponding blade is actuated to move to its starting point.

9. The dimming device of claim 8, wherein the blade that is attached to the driving wheel is integrated with the reset bar.

10. The dimming device of any of claim 1, wherein the notches are provided at an edge of the blades facing the light path and have a V, zigzag or a finger shape.

* * * * *